US008043523B2

(12) United States Patent
Kaneko

(10) Patent No.: US 8,043,523 B2
(45) Date of Patent: Oct. 25, 2011

(54) REFRIGERATING-MACHINE OIL COMPOSITION, AND COMPRESSOR MACHINE AND REFRIGERATING APPARATUS EACH EMPLOYING THE SAME

(75) Inventor: Masato Kaneko, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 12/097,883

(22) PCT Filed: Dec. 19, 2006

(86) PCT No.: PCT/JP2006/325302

§ 371 (c)(1),
(2), (4) Date: Jun. 18, 2008

(87) PCT Pub. No.: WO2007/072832

PCT Pub. Date: Jun. 28, 2007

(65) Prior Publication Data

US 2009/0090128 A1 Apr. 9, 2009

(30) Foreign Application Priority Data

Dec. 20, 2005 (JP) ..... 2005-367048

(51) Int. Cl.
*C09K 5/04* (2006.01)
*F25B 9/00* (2006.01)

(52) U.S. Cl. ..... 252/68; 252/67; 252/69; 62/84; 62/193; 62/468; 62/498; 62/529

(58) Field of Classification Search ..... 252/68, 252/67, 69; 62/84, 193, 468, 498, 529
See application file for complete search history.

(56) References Cited

U.S. PATENT DOCUMENTS

| | | | | |
|---|---|---|---|---|
| 6,008,169 | A * | 12/1999 | Kaneko | 508/501 |
| 6,261,474 | B1 * | 7/2001 | Egawa et al. | 252/68 |
| 2006/0147710 | A1 * | 7/2006 | Rockenfeller et al. | 428/375 |
| 2009/0082232 | A1 * | 3/2009 | Ikeda et al. | 508/108 |

FOREIGN PATENT DOCUMENTS

| | | | |
|---|---|---|---|
| JP | 4 506379 | | 11/1992 |
| JP | 5 117680 | | 5/1993 |
| JP | 1 113638 | | 1/1999 |
| JP | 2000 17282 | | 1/2000 |
| JP | 2000 63866 | | 2/2000 |
| JP | 2002 294268 | | 10/2002 |
| JP | 2004 277787 | | 10/2004 |
| WO | WO 02/079358 | A2 * | 10/2002 |
| WO | 2006 120923 | | 11/2006 |

* cited by examiner

*Primary Examiner* — Douglas MC Ginty
(74) *Attorney, Agent, or Firm* — Oblon, Spivak, McClelland, Maier & Neustadt, L.L.P.

(57) ABSTRACT

The present invention provides a refrigerator oil composition which satisfies both sludge dispersibility and prevention of wear and seizing of sliding parts made of aluminum and/or iron, and a compressor and a refrigeration apparatus using the refrigerator oil composition. The refrigerator oil composition is characterized by comprising a base oil which is at least one member selected from mineral oils and synthetic oils, and at least one polyamide compound having two or more amide groups in the molecule and being present in an amount of 0.01 to 5% by mass based on the total amount of the refrigerator oil composition.

2 Claims, No Drawings

REFRIGERATING-MACHINE OIL COMPOSITION, AND COMPRESSOR MACHINE AND REFRIGERATING APPARATUS EACH EMPLOYING THE SAME

TECHNICAL FIELD

The present invention relates to a refrigerator oil composition and to a compressor for a refrigerator and a refrigeration apparatus using the refrigerator oil composition. More specifically, the present invention is directed to a refrigerator oil composition containing a base oil and, added thereto, a specific compound, to a compressor for a refrigerator using the refrigerator oil composition and having a sliding part which is made of aluminum and/or iron and which has a coating of an organic coating film or an inorganic coating film as a sliding material, and to a refrigeration apparatus.

BACKGROUND ART

Lubrication of each of sliding parts of a compressor used in a refrigerator is ensured by a refrigerator oil which is compatible with a refrigerant used. When the sliding parts are made of aluminum and/or iron, however, there has still been a problem of wear and seizing. There has also been caused a problem of capillary clogging due to insufficient sludge dispersibility.

To cope with these problems, Patent Document 1 proposes the use of a refrigerator oil composition containing a base oil of a specific polyether and a phosphorothionate such as an alkyl phosphorothionate or an aryl phosphorothionate.

Patent Document 2 proposes a lubricating oil composition for a sliding part, containing a mineral oil and/or a synthetic oil and, added thereto, 0.05 to 5% by weight of a thiol.

With these proposals, however, it has still been impossible to satisfy both sludge dispersibility and performance of wear and seizure prevention of sliding parts.

In this circumstance, there is a demand to establish a refrigerator lubricating system which satisfies both sludge dispersibility and prevention of wear and seizing of sliding parts by improving the refrigerator oil or by improving both the refrigerator oil and the lubricating material.

[Patent Document 1] Japanese Unexamined Patent Publication No. 2000-17282

[Patent Document 2] Japanese Unexamined Patent Publication No. H05-117680

DISCLOSURE OF THE INVENTION

[Problems to be Solved by the Invention]

The present invention has been made with the foregoing circumstance in view and has as its object the provision of a refrigerator oil composition which satisfies both sludge dispersibility and prevention of wear and seizing of sliding parts made of aluminum and/or iron, and of a compressor and a refrigeration apparatus using the refrigerator oil composition.

[Means for Solving the Problems]

The present inventors have made an earnest study with a view toward accomplishing the above objects and, as a result, have found that the above objects can be fulfilled by using a refrigerator oil composition having a specific composition and, further, by combining the specifically tailored refrigerator oil composition with a specific sliding material coated on at least one of sliding parts in components constituting a compressing mechanism section. The present invention has been completed on the based on such findings.

Thus, in accordance with the present invention, there are provided:

(1) A refrigerator oil composition comprising a base oil which is at least one member selected from mineral oils and synthetic oils, and at least one polyamide compound having two or more amide groups in the molecule, said at least one polyamide compound being present in an amount of 0.01 to 5% by mass based on the total amount of the refrigerator oil composition;

(2) The refrigerator oil composition as defined in (1) above, wherein said base oil is at least one member selected from the group consisting of naphthenic mineral oils, paraffinic mineral oils, alkylbenzenes, alkylnaphthalenes, poly-α-olefins, polyalkylene glycols, polyoxyalkylene monoethers, polyoxyalkylene diethers, polyvinyl ethers, polyvinyl ether-polyalkylene glycol copolymers, polyol esters and polycarbonates;

(3) The refrigerator oil composition as defined in (1) or (2) above, wherein said base oil has a kinematic viscosity at 40° C. of 2 to 500 $mm^2/s$;

(4) The refrigerator oil composition as defined in any one of (1) to (3) above, wherein said polyamide compound is at least one member selected from the group consisting of saturated fatty acid bisamides, unsaturated fatty acid bisamides and aromatic bisamides;

(5) The refrigerator oil composition as defined in any one of (1) to (4) above, further comprising a phosphorus acid ester;

(6) The refrigerator oil composition as defined in any one of (1) to (5) above, further comprising at least one member selected from an antioxidant and an acid scavenger;

(7) A compressor for a refrigerator using a refrigerator oil composition which comprises a base oil which is at least one member selected from mineral oils and synthetic oils, and at least one polyamide compound having two or more amide groups in the molecule, said at least one polyamide compound being present in an amount of 0.01 to 5% by mass based on the total amount of the refrigerator oil composition, wherein said compressor has a sliding part made of aluminum and/or iron in components constituting a compression mechanism section, and wherein said sliding part has a coating of a lubricating film forming composition comprising a binder which is a resin containing nitrogen atoms, oxygen atoms and/or sulfur atoms, and at least one member selected from molybdenum disulfide, a fluorine-containing resin, graphite and carbon black;

(8) The compressor for a refrigerator as defined in (7) above, wherein said compressor compresses a refrigerant selected from carbon dioxide, a hydrofluorocarbon, a hydrocarbon and ammonia;

(9) The compressor for a refrigerator as defined in (7) or (8) above, wherein the compression mechanism of said compressor uses at least one operation type selected from a scroll type, a rotary type, a swing type and a piston type; and

(10) A refrigeration apparatus configured to circulate a refrigerant selected from carbon dioxide, a hydrofluorocarbon, a hydrocarbon and ammonia through a cooling circuit including a compressor, a radiator, an expansion mechanism and an evaporator, said compressor using a refrigerator oil composition comprising a base oil which is selected from mineral oils and synthetic oils and has a kinematic viscosity at 40° C. of 2 to 500 $mm^2/s$, and at least one polyamide compound which has two or more amide groups in the molecule and which is present in an amount of 0.01 to 5% by mass based on the total amount of the refrigerator oil composition, said compressor having a sliding part which is made of an aluminum and/or iron and which has a coating of a lubricating film forming composition comprising a binder which is at least one resin selected from the group consisting of a polyamide, a polyamideimide, a polyimide, a polybenzoazole, a polyphenylene sulfide and a polyacetal, and at least one member selected from molybdenum disulfide, a fluorine-containing resin, graphite and carbon black.

[Effect of the Invention]

The use of the refrigerator oil composition according to the present invention can satisfy both sludge dispersibility and prevention of wear and seizing of sliding parts, made of aluminum and/or iron, of a compressor for a refrigerator.

[Best Mode for Carrying Out the Invention]

In the refrigerator oil composition of the present invention, at least one member selected from mineral oils and synthetic oils is used as a base oil. As the mineral oil, there may be mentioned naphthenic mineral oils and paraffinic mineral oils. As the synthetic oil, on the other hand, there may be mentioned, for example, alkylbenzenes, alkylnaphthalenes, poly-α-olefins, polyalkylene glycols, polyoxyalkylene monoethers, polyoxyalkylene diethers, polyvinyl ethers, polyvinyl ether-polyalkylene glycol copolymers, polyol esters and polycarbonates.

Among these mineral oils and synthetic oils, polyvinyl ethers, polyalkylene glycols, polyoxyalkylene monoethers, polyoxyalkylene diethers, polyvinyl ether-polyalkylene glycol copolymers, polyol esters and polycarbonates are preferred.

It is preferred that the base oil used in the refrigerator oil composition of the present invention have a kinematic viscosity at 40° C. of 2 to 500 $mm^2/s$, more preferably 3 to 300 $mm^2/s$. A kinematic viscosity of 2 $mm^2/s$ or more provides a satisfactory lubrication, while a kinematic viscosity of 500 $mm^2/s$ or less can reduce a viscosity resistance and, therefore, provides excellent energy saving efficiency and oil returnability.

The polyamide compound having at least two amide groups in the molecule, which is compounded into the refrigerator oil composition of the present invention, is preferably a saturated fatty acid bisamide, an unsaturated fatty acid bisamide and/or an aromatic bisamide.

The refrigerator oil composition of the present invention contains at least one of these polyamide compounds in an amount of 0.01 to 5% by mass, preferably 0.1 to 4% by mass, particularly preferably 0.2 to 2% by mass, based on the total amount of the refrigerator oil composition. When the amount is less than 0.01% by mass, lubricating efficiency and sludge dispersibility are deteriorated. When the amount is greater than 5% by mass, the stability becomes deteriorated.

As the saturated fatty acid bisamide, there may be preferably mentioned, for example, methylenebislauramide, methylenebisstearamide, methylenebishydroxystearamide, ethylenebiscaprylamide, ethylenebiscapramide, ethylenebislauramide, ethylenebisstearamide, ethylenebisisostearamide, ethylenebishydroxystearamide, ethylenebisbehenamide, hexamethylenebisstearamide, hexamethylenebisbehenamide, hexamethylenebishydroxystearamide, butylenebishydroxystearamide, N,N'-distearyladipamide, N,N'-distearylsebacamide, a condensation product of caprylic acid with diethylenetriamine (molar ratio 3:1), a condensation product of lauric acid with triethylenetriamine (molar ratio 4:1), a condensation product of propanoic acid with tridecaethylenetetradecamine (molar ratio 11:1) and a condensation product of isostearic acid with tetraethylenepentamine (molar ratio 3:1).

As the unsaturated fatty acid bisamide, there may be preferably mentioned, for example, methylenebisoleamide, ethylenebisoleamide, ethylenebiserucamide, hexamethylenebisoleamide, N,N'-dioleyladipamide, N,N'-dioleylsebacamide and a condensation product of oleic acid with triethylenetriamine (molar ratio 3:1).

As the aromatic bisamide, there may be preferably mentioned, for example, m-xylylenebisstearamide and N,N'-distearylisophthalamide.

The refrigerator oil composition of the present invention may be compounded with a variety of known additives if necessary. It is preferred that the refrigerator oil composition of the present invention contain a phosphorus acid ester as an extreme pressure agent. The term "phosphorus acid ester" as used herein is intended to include a phosphate, an acid phosphate, a phosphite, an acid phosphite and amine salts of them.

The phosphate may be, for example, a triaryl phosphate, a trialkyl phosphate, a trialkylaryl phosphate, a triarylalkyl phosphate or a trialkenyl phosphate. Specific examples of the phosphate include triphenyl phosphate, tricresyl phosphate, benzyl diphenyl phosphate, ethyl diphenyl phosphate, tributyl phosphate, ethyl dibutyl phosphate, cresyl diphenyl phosphate, dicresyl phenyl phosphate, ethylphenyl diphenyl phosphate, diethylphenyl phenyl phosphate, propylphenyl diphenyl phosphate, dipropylphenyl phenyl phosphate, triethylphenyl phosphate, tripropylphenyl phosphate, butylphenyl diphenyl phosphate, dibutylphenyl phenyl phosphate, tributylphenyl phosphate, trihexyl phosphate, tri(2-ethylhexyl) phosphate, tridecyl phosphate, trilauryl phosphate, trimyristyl phosphate, tripalmityl phosphate, tristearyl phosphate and trioleyl phosphate.

Specific examples of the acid phosphate include 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate and isostearyl acid phosphate.

Specific examples of the phosphite include triethyl phosphite, tributyl phosphite, triphenyl phosphite, tricresyl phosphite, tri(nonylphenyl) phosphite, tri(2-ethylhexyl) phosphite, tridecyl phosphite, trilauryl phosphite, triisooctyl phosphite, diphenylisodecyl phosphite, tristearyl phosphite and trioleyl phosphite.

Specific examples of the acid phosphite include dibutyl hydrogen phosphite, dilauryl hydrogen phosphite, dioleyl hydrogen phosphite, distearyl hydrogen phosphite and diphenyl hydrogen phosphite. Among the above phosphorus acid esters, oleyl acid phosphate and stearyl acid phosphate are particularly preferable.

Amines that form amine salts with the above described phosphates, acid phosphates, phosphites and acid phosphites are exemplified below.

Examples of the monosubstituted amine include butylamine, pentylamine, hexylamine, cyclohexylamine, octylamine, laurylamine, stearylamine, oleylamine and benzylamine. Examples of the disubstituted amine include dibutylamine, dipentylamine, dihexylamine, dicyclohexylamine, dioctylamine, dilaurylamine, distearylamine, dioleylamine, dibenzylamine, stearylmonoethanolamine, decylmonoethanolamine, hexylmonopropanolamine, benzylmonoethanolamine, phenylmonoethanolamine and tolylmonopropanolamine. Examples of the trisubstituted amine include tributylamine, tripentylamine, trihexylamine, tricyclohexylamine, trioctylamine, trilaurylamine, tristearylamine, trioleylamine, tribenzylamine, dioleylmonoethanolamine, dilaurylmonopropanolamine, dioctylmonoethanolamine, dihexylmonopropanolamine, dibutylmonopropanolamine, oleyldiethanolamine, stearyldipropanolamine, lauryidiethanolamine, octyldipropanolamine, butyldiethanolamine, benzyldiethanolamine, phenyldiethanolamine, tolyidipropanolamine, xylyldiethanolamine, triethanolamine and tripropanolamine.

It is also preferred that the refrigerator oil composition of the present invention contain an antioxidant and an acid scavenger.

As the antioxidant, there may be mentioned a phenol-based antioxidant and an amine-based antioxidant. To be more specific, it is preferable to use a phenol-based antioxidant such as 2,6-di-tert-butyl-4-methylphenol (DBPC), 2,6-di-tert-butyl-4-ethylphenol, 2,2'-methylenebis(4-methyl-6-tert-butylphenol), 2,4-dimethyl-6-tert-butylphenol and 2,6-di-tert-butylphenol, or an amine-based antioxidant such as N,N'-diisopropyl-p-phenylenediamine, N,N'-di-sec-butyl-p-phenylenediamine, phenyl-α-naphthylamine and N,N'-diphenyl-p-phenylenediamine. The antioxidant is compounded in the composition in an amount of generally 0.01 to 5% by mass, preferably 0.05 to 3% by mass, based on the total amount of the refrigerator oil composition.

As the acid scavenger, there may be mentioned, for example, phenyl glycidyl ether, an alkyl glycidyl ether, an alkylene glycol glycidyl ether, cyclohexene oxide, an α-olefin oxide and an epoxy compound such as epoxidized soybean oil. Among these, phenyl glycidyl ether, alkyl glycidyl ether, alkylene glycol glycidyl ether, cyclohexane oxide and α-olefin oxide are preferred from the standpoint of compatibility.

Each of the alkyl group of the alkyl glycidyl ether and the alkylene group of the alkylene glycol glycidyl ether may be branched and has generally 3 to 30, preferably 4 to 24, particularly 6 to 16 carbon atoms. The α-olefin oxide used has a total carbon number of generally 4 to 50, preferably 4 to 24, particularly 6 to 16. In the present invention, the above-described acid scavengers may be used singly or in combination of two or more thereof. The compounding amount of the acid scavenger is generally preferably in the range of 0.005 to 5% by mass, particularly preferably 0.05 to 3% by mass, based on the total amount of the refrigerator oil composition from the standpoint of the acid scavenging effect and the suppression of the sludge generation.

Further, the refrigerator oil composition of the present invention may contain known additives customarily employed in the conventional lubricating oils and may contain, for example, an extreme pressure agent other than those described above. Such "other extreme pressure agent" may be, for example, an organic sulfur compound-based agent such as a monosulfide, a polysulfide, a sulfoxide, a sulfone, a thiosulfinate, a sulfurized fat, a thiocarbonate, a thiophene, a thiazole and a methanesulfonate; a thiophosphate-based agent such as a triester of thiophosphoric acid; a higher fatty acid; a hydroxyarylfatty acid; an ester-based agent such as an ester of a polyhydric alcohol and an acrylate; an organic chlorine compound-based agent such as a chlorinated hydrocarbon and a chlorinated carboxylic acid derivative; an organic fluorine compound-based agent such as a fluorinated aliphatic carboxylic acid, a fluorinated ethylene resin, a fluorinated alkylpolysiloxane and a fluorinated graphite; an alcohol-based agent such as a higher alcohol; a metal compound-based agent such as a naphthenic acid salt (e.g. lead naphthenate), a fatty acid salt (a lead salt of a fatty acid), a thiophosphoric acid salt (zinc dialkyldithiophosphate), a thiocarbamic acid salt, an organomolybdenum compound, an organotin compound, an organogermanium compound and a boric acid ester.

Furthermore, a copper deactivator such as benzotriazole and its derivatives may be compounded into the refrigerator oil composition. The refrigerator oil composition may further comprise other additives such as a load withstanding additive, a chlorine scavenger, a detergent dispersant, a viscosity index improver, an oiliness agent, a rust preventive agent, a corrosion inhibitor, a pour point improver and an antifoaming agent. These additives may be present in the refrigerator oil composition in an amount of 0.1 to 10% by mass, preferably 0.5 to 10% by mass, based on the total amount of the refrigerator oil composition.

The compressor for a refrigerator according to the present invention has at least one sliding part made of aluminum and/or iron in components constituting a compression mechanism section thereof. The compressor is characterized in that the at least one sliding part has a coating of a lubricating material. As the lubricating material, an organic coating film or an inorganic coating film is suitably used.

The organic coating film is more preferably composed of a lubricating film forming composition containing as a binder a resin having a heat distortion temperature of 100° C. or more and a solid lubricating agent.

The term "heat distortion temperature (HDT)" as used herein is intended to refer to a temperature at which the plastic is deformed when it is heated at a constant rate with a given load being applied thereto and is a temperature as determined in accordance with Heat Distortion Temperature Test specified in ASTM D648 (1.8 MPa).

The inorganic coating film may be an inorganic material film and/or a metal plating film. The inorganic material may be graphite, diamond-like carbon (DLC), titanium carbide (TiC), boron nitride (BN), etc. The metal plating film may be preferably at least one member selected from nickel platings, molybdenum platings, tin platings, chromium platings, KANIFLON platings, KANIZEN platings, iron-based alloy platings, aluminum-based alloy platings and copper-based alloy platings.

These inorganic material films and metal plating films may be preferably formed by a vacuum deposition method. Examples of the vacuum deposition method include a chemical vapor deposition (CVD) method (e.g. a plasma CVD method) and a physical vapor deposition (PVD) method (e.g. an ion plating method and a sputtering method). As a method for forming a metal plating film, there may be used electrolytic plating and electroless plating.

When the above-described lubricating film forming composition is used as the lubricating material in the present invention, the sliding part made of aluminum and/or iron exhibits significantly improved lubricity at the start of and during the operation of the compressor for a refrigerator because of an interaction between the lubricating material and the polyamide compound. Therefore, the use of the lubricating film forming composition is particularly preferred.

The binder used in the lubricating film forming composition is preferably a resin having a heat distortion temperature of 100° C. or more, more preferably 150° C. or more, still more preferably 200° C. or more, particularly preferably 250° C. or more.

More specifically, the binder is preferably a resin containing nitrogen atoms, oxygen atoms and/or sulfur atoms. Examples of the resin include an epoxy resin, a phenol resin, a fluorine-containing resin, an unsaturated polyester, a polyacetal, a polyimide, a polyamideimide, a polyamide, a polycarbonate, a polysulfone, a polyphenylene sulfide and a polybenzoazole. Above all, a polyamide, a polyimide, a polyamideimide, a polybenzoazole, a polyphenylene sulfide and a polyacetal are particularly preferred for reasons of excellent heat stability.

As the polyamide, there may be mentioned, for example, an aromatic polyamide, a polyether amide and a modified product thereof. As the polyimide, there may be mentioned, for example, an aromatic polyimide, a polyether imide and a modified product thereof. As the polyamideimide, there may be mentioned, for example, an aromatic polyamideimide and a modified product thereof. As the polybenzoazole, there may be suitably mentioned, for example, a polybenzoimidazole. These resins may be used by themselves or as a mixture of two or more thereof.

In the present invention, the above-described binder is contained in the lubricating film forming composition. The composition is applied to at least one sliding part made of aluminum and/or iron in components constituting a compression mechanism section. The binder is preferably present in the lubricating film forming composition in an amount of 20 to 100% by mass based on the total amount of the lubricating film forming composition. When the amount is 20% by mass or more, a solid lubricating agent which is mentioned later can be firmly supported within the lubricating film, so that sufficient lubricity can be obtained. The amount of the binder in the lubricating film forming composition is more preferably in a range of 20 to 80% by mass in compounding the solid lubricating agent.

Any solid lubricating agent may be used as long as it can exhibit lubricating action in a solid state. Specific examples of the solid lubricating agent include graphite, carbon black, molybdenum disulfide, tungsten sulfide, fluorine-containing polymers (particularly fluorine-containing resins), boron nitride and graphite. Among these, molybdenum disulfide, fluorine-containing resins, graphite and carbon black are preferred. These solid lubricating agents may be used by themselves or as a mixture of two or more thereof.

The average particle diameter of the solid lubricating agent contained in the lubricating film is not specifically limited. For reasons of formation of dense lubricating films, it is preferred that the average particle diameter be in a range of 1 to 100 μm.

The content of the solid lubricating agent is preferably in a range of 20 to 80 parts by mass per 100 parts by mass of the binder resin. When the content is 20 parts by mass or more, sufficient lubricity can be obtained. When the content is not greater than 80 parts by mass, no reduction of the action of binding the solid lubricating agent in the lubricating film due to a decrease of the content of the binder occurs and, therefore, no abrasion or exfoliation of the solid lubricating agent occurs. The content of the solid lubricating agent is more preferably in a range of 30 to 70 parts by mass per 100 parts by mass of the binder resin.

It is preferred that the lubricating film forming composition contain a film forming aid. Illustrative of suitable film forming aids are, for example, epoxy group-bearing compounds and silane coupling agents. The film forming aid serves to improve the action of holding the solid lubricating agent.

The film forming aid is preferably used in such an amount that the ratio by mass of the binder resin to the film forming aid is in a range of 99:1 to 70:30.

A variety of known additives may be compounded into the lubricating film forming composition if necessary. For example, an extreme pressure agent such as a phosphate (e.g. tricresyl phosphate (TCP)) and a phosphite (e.g. tri(nonylphenyl)phosphite); an antioxidant such as a phenol-based and amine-based antioxidant; a stabilizer such as phenyl glycidyl ether, cyclohexene oxide, epoxidized soy bean oil; and a copper deactivator such as benzotriazole and its derivatives, may be compounded into the lubricating film forming composition as desired. In addition, the lubricating film forming composition may comprise a load withstanding additive, a chlorine scavenger, a detergent dispersant, a viscosity index improver, an oiliness agent, a rust preventive agent, a corrosion inhibitor, a pour point improver, etc. These additives may be present in the refrigerator oil composition in an amount of 0.1 to 10% by mass, preferably 0.5 to 10% by mass, based on the total amount of the refrigerator oil composition.

The thickness of the lubricating film is not specifically limited as long as the effect of the present invention may be ensured, but is preferably in a range of 2 to 50 μm. When the thickness is 2 μm or more, sufficient lubricity can be ensured. When the thickness is 50 μm or less, fatigue resistance can be maintained. From these points of view, the thickness of the lubricating film is more preferably in a range of 4 to 25 μm.

The lubricating film forming composition is applied to at least one sliding part made of aluminum and/or iron in components constituting a compression mechanism section. The coating method is not specifically limited. Examples of the coating method include a method in which a lubricating film forming composition is prepared by dispersing a solid lubricating agent in a solution of the above-described binder in an organic solvent and in which the obtained composition is directly applied to a sliding part made of aluminum and/or iron; and a method in which a sliding part made of aluminum and/or iron is immersed in the above-obtained composition. The sliding part made of aluminum and/or iron on which the composition has been applied is then treated by drying or the like method to remove the solvent, thereby forming a lubricating film.

The refrigerator oil of the present invention may be used for a variety of refrigerants. Suitable examples of the refrigerant include a carbon dioxide refrigerant, a hydrocarbon-based refrigerant, an ammonia-based refrigerant and a hydrofluorocarbon-based refrigerant. Among these refrigerants, a carbon dioxide refrigerant is particularly suitably used.

It is preferred that the compressor for a refrigerator according to the present invention be a compressor which uses the above-described refrigerator oil composition and which has a sliding part made of aluminum and/or iron in components constituting a compression mechanism section, with the sliding part having a coating of a lubricating film forming composition containing a binder, which is a resin containing nitrogen atoms, oxygen atoms and/or sulfur atoms, and at least one member selected from molybdenum disulfide, a fluorine-containing resin, graphite and carbon black. The term "components constituting a compression mechanism section" as used herein is intended to comprise, for example, a piston and a cylinder in the case of a reciprocating piston compressor. The above-described lubricating film forming composition is coated on such a sliding part or parts made of aluminum and/or iron so that lubricity of the sliding part or parts made of aluminum and/or iron is ensured by using the refrigerator oil composition.

The present invention also provides a refrigeration apparatus configured to circulate a refrigerant selected from carbon dioxide, a hydrofluorocarbon, a hydrocarbon and ammonia through a cooling circuit including the above-described compressor, a radiator, an expansion mechanism and an evaporator.

It is preferred that the moisture content in a system of the refrigeration apparatus be not greater than 300 ppm for reasons of suppressing hydrolysis and corrosion. It is also preferred that the residual air content be not greater than 50 ppm for suppressing oxidative deterioration.

EXAMPLES

The present invention will be next described in more detail by way of examples but is not restricted to these examples in any way.

Refrigerator oil compositions were evaluated by the following methods.

(1) Closed Block on Ring Abrasion Test

Block abrasion width (mm) was determined under the following conditions. Load: 100 N; Rotating speed: 1,000 rpm; Time: 20 minutes; Temperature: 50° C.; Refrigerant: carbon dioxide; Refrigerant pressure: 1 MPa; Block/ring: A4032/MoNiChro cast iron.

(2) Dispersibility Test

A sample oil was mixed with 0.5% by mass of barium sulfonate-based rust preventive agent and maintained at −5° C. Whether or not precipitation occurred was checked.

Examples 1 to 15 and Comparative Examples 1 to 3

Eighteen refrigerator oil compositions having formulations shown in Table 1 were prepared and evaluated by the above methods. The results are summarized in Table 1.

TABLE 1

| Compounding amount (% by mass) | | Example 1 | Example 2 | Example 3 | Example 4 | Example 5 | Example 6 |
|---|---|---|---|---|---|---|---|
| Sample Oil No. | | Sample Oil 1 | Sample Oil 2 | Sample Oil 3 | Sample Oil 4 | Sample Oil 5 | Sample Oil 6 |
| Base Oil | A1 | 96.5 | 96.5 | 96.5 | 96.5 | 96.5 | 96.5 |
| | A2 | | | | | | |
| | A3 | | | | | | |
| | A4 | | | | | | |
| | A5 | | | | | | |
| | A6 | | | | | | |
| Polyamide Compound | B1 | 1 | | | | | |
| | B2 | | 1 | | | | |
| | B3 | | | 1 | | | |
| | B4 | | | | 1 | | |
| | B5 | | | | | 1 | |
| | B6 | | | | | | 1 |
| | B7 | | | | | | |
| | B8 | | | | | | |
| | B9 | | | | | | |
| | B10 | | | | | | |
| Extreme Pressure Agent | C1 | 1 | 1 | 1 | 1 | 1 | 1 |
| Acid Scavenger | C2 | 1 | 1 | 1 | 1 | 1 | 1 |
| Antioxidant | C3 | 0.5 | 0.5 | 0.5 | 0.5 | 0.5 | 0.5 |
| Antifoaming Agent | C4 | 0.001 | 0.001 | 0.001 | 0.001 | 0.001 | 0.001 |
| Block Abrasion Width (mm) | | 1.2 | 0.9 | 1.4 | 1.2 | 1.1 | 1.4 |
| Dispersibility Test | | No precipitation | No precipitation | No precipitation | No precipitation | No precipitation | No precipitation |

| Compounding amount (% by mass) | | Example 7 | Example 8 | Example 9 | Example 10 | Example 11 | Example 12 |
|---|---|---|---|---|---|---|---|
| Sample Oil No. | | Sample Oil 7 | Sample Oil 8 | Sample Oil 9 | Sample Oil 10 | Sample Oil 11 | Sample Oil 12 |
| Base Oil | A1 | 96.5 | 96.5 | 96.5 | 96.5 | | |
| | A2 | | | | | 96.5 | |
| | A3 | | | | | | 96.5 |
| | A4 | | | | | | |
| | A5 | | | | | | |
| | A6 | | | | | | |
| Polyamide Compound | B1 | | | | | 1 | 1 |
| | B2 | | | | | | |
| | B3 | | | | | | |
| | B4 | | | | | | |
| | B5 | | | | | | |
| | B6 | | | | | | |
| | B7 | 1 | | | | | |
| | B8 | | 1 | | | | |
| | B9 | | | 1 | | | |
| | B10 | | | | 1 | | |
| Extreme Pressure Agent | C1 | 1 | 1 | 1 | 1 | 1 | 1 |
| Acid Scavenger | C2 | 1 | 1 | 1 | 1 | 1 | 1 |

TABLE 1-continued

| | | | | | | | |
|---|---|---|---|---|---|---|---|
| Antioxidant | C3 | 0.5 | 0.5 | 0.5 | 0.5 | 0.5 | 0.5 |
| Antifoaming Agent | C4 | 0.001 | 0.001 | 0.001 | 0.001 | 0.001 | 0.001 |
| Block Abrasion Width (mm) | | 1.5 | 1.3 | 1.3 | 1.2 | 1.2 | 1.2 |
| Dispersibility Test | | No precipitation | No precipitation | No precipitation | No precipitation | No precipitation | No precipitation |

| Compounding amount (% by mass) | | Example 13 | Example 14 | Example 15 | Comparative Example 1 | Comparative Example 2 | Comparative Example 3 |
|---|---|---|---|---|---|---|---|
| Sample Oil No. | | Sample Oil 13 | Sample Oil 14 | Sample Oil 15 | Sample Oil 16 | Sample Oil 17 | Sample Oil 18 |
| Base Oil | A1 | | | | 97.5 | | |
| | A2 | | | | | 97.5 | |
| | A3 | | | | | | 97.5 |
| | A4 | 96.5 | | | | | |
| | A5 | | 96.5 | | | | |
| | A6 | | | 96.5 | | | |
| Polyamide Compound | B1 | 1 | 1 | 1 | | | |
| | B2 | | | | | | |
| | B3 | | | | | | |
| | B4 | | | | | | |
| | B5 | | | | | | |
| | B6 | | | | | | |
| | B7 | | | | | | |
| | B8 | | | | | | |
| | B9 | | | | | | |
| | B10 | | | | | | |
| Extreme Pressure Agent | C1 | 1 | 1 | 1 | 1 | 1 | 1 |
| Acid Scavenger | C2 | 1 | 1 | 1 | 1 | 1 | 1 |
| Antioxidant | C3 | 0.5 | 0.5 | 0.5 | 0.5 | 0.5 | 0.5 |
| Antifoaming Agent | C4 | 0.001 | 0.001 | 0.001 | 0.001 | 0.001 | 0.001 |
| Block Abrasion Width (mm) | | 1.2 | 1.7 | 1.9 | 5.2 | 3.8 | 4.1 |
| Dispersibility Test | | No precipitation | No precipitation | No precipitation | Precipitation Occuured | Precipitation Occuured | Precipitation Occuured |

Remarks:
A1: Polyvinyl ether (kinematic viscosity at 40° C.: 68.1 $mm^2/s$)
A2: Polyalkylene glycol (kinematic viscosity at 40° C.: 46.7 $mm^2/s$)
A3: Polyvinyl ether-polyalkylene glycol copolymer (molar ratio: 1/1): (kinematic viscosity at 40° C.: 75.2 $mm^2/s$)
A4: Polyol ester (kinematic viscosity at 40° C.: 68.5 $mm^2/s$)
A5: Polycarbonate (kinematic viscosity at 40° C.: 67.9 $mm^2/s$)
A6: Paraffinic mineral oil (kinematic viscosity at 40° C.: 101.0 $mm^2/s$)
B1: Methylenebislauramide (manufactured by Nihon Kasei Co., Ltd.)
B2: Methylenebisstearamide (manufactured by Nihon Kasei Co., Ltd.)
B3: Ethylenebiscaprylamide (manufactured by Nihon Kasei Co., Ltd.)
B4: Ethylenebislauramide (manufactured by Nihon Kasei Co., Ltd.)
B5: Ethylenebisoleamide (manufactured by Nihon Kasei Co., Ltd.)
B6: Condensate of caprylic acid with diethylenetriamine (molar ratio: 3/1)
B7: Condensate of lauric acid with triethylenetetramine (molar ratio: 4/1)
B8: Condensate of oleic acid with triethylenetetramine (molar ratio: 3/1)
B9: Condensate of isostearic acid with tetraethylenepentamine (molar ratio: 3/1)
B10: Condensate of propanoic acid with tridecaethylenetetradecamine (molar ratio: 11/1)
C1: Tricresyl phosphate (TCP)
C2: $C_{14}$-α-Olefin oxide
C3: 2,6-Di-tert-butyl-4-methylphenol (DBPC)
C4: Silicon-based antifoaming agent As is evident from Table 1, the refrigerator oil composition of the present invention is excellent in both sludge dispersibility and prevention of wear and seizing of sliding parts, made of aluminum and/or iron, of a compressor for a refrigerator.

A lubricating film forming composition containing a polyamideimide as a binder and a mixture of molybdenum disulfide and polytetrafluoroethylene (PTFE) as a solid lubricating agent (ratio of polyamideimide/molybdenum disulfide/PTFE=100/25/25 (parts by mass)) was applied to sliding parts, made of aluminum and/or iron, in components constituting a compression mechanism section to a thickness of 30 μm. The coated films were each processed to a thickness of 10 to 20 μm and surface roughness Rz (10-point average roughness) of 3.2 μm or less. Using each of the fifteen refrigerator oil compositions obtained in Examples 1 to 15, the compressor for a refrigerator having such sliding parts was operated. At the start of and during the operation of the compressor, lubricity of the aluminum sliding part and the iron sliding part was evaluated. It was found that the fifteen refrigerator oil compositions of Examples 1 to 15 showed excellent lubricity in both the aluminum and iron sliding parts.

INDUSTRIAL APPLICABILITY

The refrigerator oil composition according to the present invention, and a compressor and a refrigeration apparatus using the refrigerator oil composition may be used in a refrigerator of an open type, a semi-close type or a close type and are suitably used in a refrigeration system (such as a car air conditioner, a gas heat pump, an air conditioner, a refrigerator, a vending machine and a showcase), a water heater system and a floor heating system.

The invention claimed is:

1. A compressor for a refrigerator comprising:

a refrigerator oil composition, comprising:

a base oil which is at least one member selected from mineral oils and synthetic oils, and from 0.01 to 5% by mass based on the total amount of the refrigerator oil composition of at least one polyamide compound having two or more amide groups in the molecule;

a refrigerant; and a compression mechanism section comprising a sliding part made of aluminum and/or iron;

wherein the sliding part has a coating of a lubricating film forming composition comprising a binder which is a resin containing nitrogen atoms, oxygen atoms and/or sulfur atoms, and at least one member selected from molybdenum disulfide, a fluorine-containing resin, graphite and carbon black, and the refrigerator oil composition contacts the lubricating film and ensures the lubricity of the lubricating film composition.

2. A method for lubricating a sliding part of a compressor of a refrigerator, comprising:

coating the sliding part with a lubricating organic film comprising:

a binder which is a resin having at least one of nitrogen atoms, oxygen atoms and sulfur atoms, and at least one member selected from molybdenum disulfide, a fluorine-containing resin, graphite and carbon black; and contacting the sliding member with a refrigerator oil composition, comprising:

a base oil which is at least one member selected from mineral oils and synthetic oils, and at least one polyamide compound having two or more amide groups in the molecule, wherein a % by mass of the at least one polyamide compound is from 0.01 to 5% by mass based on the total amount of the refrigerator oil composition; and the sliding part is made of aluminum, iron or aluminum and iron.

* * * * *

UNITED STATES PATENT AND TRADEMARK OFFICE

CERTIFICATE OF CORRECTION

PATENT NO. : 8,043,523 B2
APPLICATION NO. : 12/097883
DATED : October 25, 2011
INVENTOR(S) : Masato Kaneko It is certified that error appears in the above-identified patent and that said Letters Patent is hereby corrected as shown below:

On the title page, Item (54) and column 1, should read:

-- REFRIGERATING-MACHINE OIL COMPOSITION, AND COMPRESSOR FOR REFRIGERATING MACHINE AND REFRIGERATING APPARATUS EACH EMPLOYING THE SAME --

Signed and Sealed this
Twentieth Day of December, 2011

David J. Kappos

David J. Kappos
*Director of the United States Patent and Trademark Office*